US009295351B2

(12) United States Patent
Schaffer

(10) Patent No.: US 9,295,351 B2
(45) Date of Patent: Mar. 29, 2016

(54) BENDABLE CLOTHES HANGER

(71) Applicant: Alyssa Nicole Schaffer, Valencia, CA (US)

(72) Inventor: Alyssa Nicole Schaffer, Valencia, CA (US)

( * ) Notice: Subject to any disclaimer, the term of this patent is extended or adjusted under 35 U.S.C. 154(b) by 0 days.

(21) Appl. No.: 14/335,443

(22) Filed: Jul. 18, 2014

(65) Prior Publication Data

US 2015/0021367 A1 Jan. 22, 2015

Related U.S. Application Data

(60) Provisional application No. 61/847,765, filed on Jul. 18, 2013.

(51) Int. Cl.

| | |
|---|---|
| ***A47G 25/36*** | (2006.01) |
| ***A47G 25/28*** | (2006.01) |
| ***A47G 25/14*** | (2006.01) |
| ***A47F 7/19*** | (2006.01) |

(52) U.S. Cl.

CPC . *A47G 25/36* (2013.01); *A47F 7/19* (2013.01); *A47G 25/14* (2013.01); *A47G 25/28* (2013.01)

(58) Field of Classification Search

CPC ..... A47F 7/19; A41D 27/22; A47G 25/06; A47G 25/28; A47G 25/32; A47G 25/36; A47G 25/40; A47G 25/4015; A47G 25/14; A47G 25/02; A47G 25/0607; A47G 25/16; A47G 25/18; A47G 25/20; A47G 25/24; A47G 25/26; A47G 25/30; A47G 25/325; A47G 25/34

USPC ..... 223/85

See application file for complete search history.

(56) References Cited

U.S. PATENT DOCUMENTS

| | | | | |
|---|---|---|---|---|
| 834,652 | A * | 10/1906 | Barrell et al. | 223/94 |
| 3,052,390 | A | 9/1962 | Gingher | |
| 3,348,745 | A * | 10/1967 | Gino et al. | 223/88 |
| 3,430,827 | A * | 3/1969 | Nelson | 223/89 |
| 4,854,489 | A * | 8/1989 | Radcliffe | 223/95 |
| 4,981,242 | A * | 1/1991 | Grahm | 223/94 |
| 5,069,373 | A | 12/1991 | Kolton et al. | |
| 6,065,653 | A | 5/2000 | Lin | |
| 6,328,186 | B1 * | 12/2001 | Wing | 223/94 |
| 6,499,636 | B1 | 12/2002 | McCool | |
| 2004/0195279 | A1 | 10/2004 | Mazzucchelli | |
| 2009/0270689 | A1 * | 10/2009 | Galland | 600/300 |
| 2013/0112721 | A1 * | 5/2013 | Presser | 223/85 |
| 2015/0024153 | A1 * | 1/2015 | Salayi | 428/34.1 |

FOREIGN PATENT DOCUMENTS

| | | | |
|---|---|---|---|
| CN | 201290557 | Y | 8/2009 |
| ES | 1134959 | U * | 12/2014 |

(Continued)

OTHER PUBLICATIONS

International Search Report dated Nov. 12, 2014 from corresponding international application PCT/US2014/047306 USPTO PCT Division/ Authorized Officer Blaine R. Copenheaver.

*Primary Examiner* — Ismael Izaguirre

(57) ABSTRACT

Some embodiments of the present disclosure include a bendable clothes hanger for hanging clothing. The bendable clothes hanger may have a silicone hanger body, and a substantially flat hook attached to the silicone hanger body. In some embodiments, the hook may have a curved portion and a plate extending from a bottom portion of the curved portion, wherein the plate is positioned within an interior of the silicone hanger body and the curved portion of the hook extends out of the interior of the silicone hanger body through a slot. The silicone hanger body may be configured to bend to be placed within an article of clothing.

8 Claims, 3 Drawing Sheets

(56) References Cited

FOREIGN PATENT DOCUMENTS

| | | | | |
|---|---|---|---|---|
| FR | 00274352 | A1 | * | 8/1997 |
| IN | 20120124813 | | * | 1/2014 |
| JP | 2006068465 | A | * | 3/2006 |
| JP | 2008269201 | A | * | 11/2008 |
| JP | 4452770 | B1 | * | 4/2009 |
| JP | 2010-264200 | A | | 11/2010 |
| JP | 2010264200 | A | * | 11/2010 |
| JP | 2012239792 | A | * | 12/2012 |

* cited by examiner

BENDABLE CLOTHES HANGER

RELATED APPLICATION

This application claims priority to provisional patent application U.S. Ser. No. 61/847,765 filed on Jul. 18, 2013, the entire contents of which is herein incorporated by reference.

BACKGROUND

The embodiments herein relate generally to home goods, and more particularly, to a bendable clothes hanger made from silicone.

Conventional clothes hangers are rigid, resulting in a hanger becoming tangled with other hangers or with clothing. Sometimes, conventional clothes hangers also require stretching the collar of an article of clothing to either put the clothing on the hanger or to take it off of the hanger. Moreover, some conventional hangers are slick, causing clothing to fall off of the hangers onto the floor of a closet.

Therefore, what is needed is a clothes hanger having a bendable or foldable anti-slip body to prevent tangling of the hanger with other items, to prevent stretching of the collar of an article of clothing, and to prevent clothing slipping off of the hanger.

SUMMARY

Some embodiments of the present disclosure include a bendable clothes hanger for hanging clothing. The bendable clothes hanger may have a silicone hanger body, and a substantially flat hook attached to the silicone hanger body. In some embodiments, the hook may have a curved portion and a plate extending from a bottom portion of the curved portion, wherein the plate is positioned within an interior of the silicone hanger body and the curved portion of the hook extends out of the interior of the silicone hanger body through a slot. The silicone hanger body may be configured to bend to be placed within an article of clothing.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
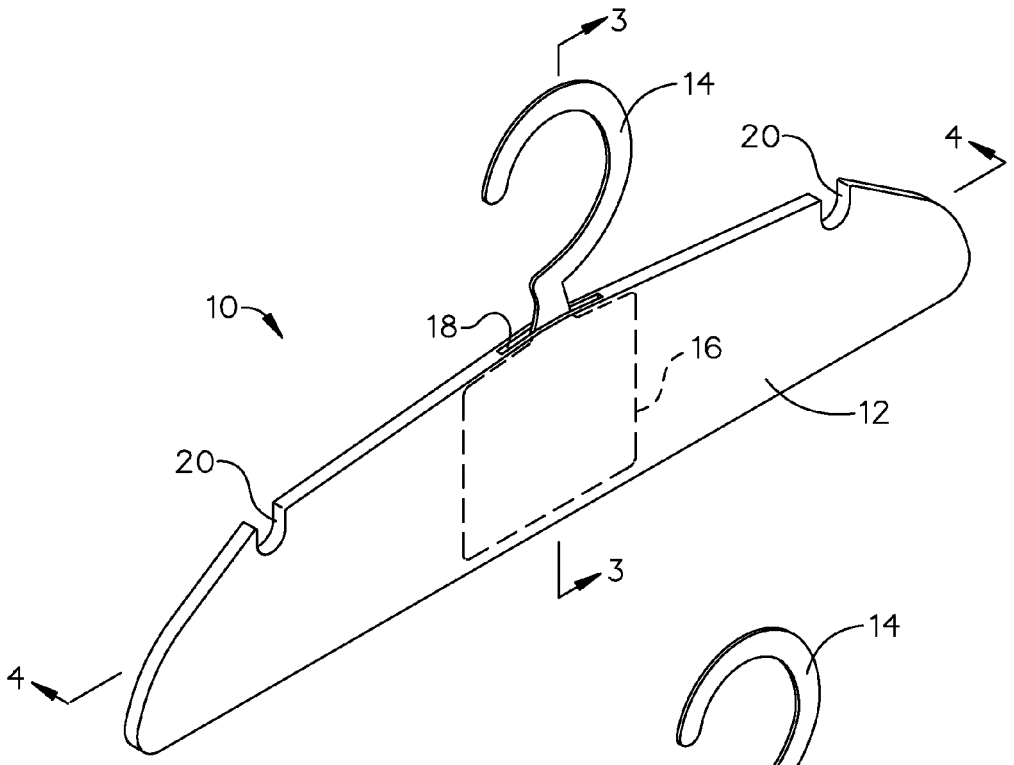
FIG. 1 is a perspective view of one embodiment of the present invention.
Figure 2:
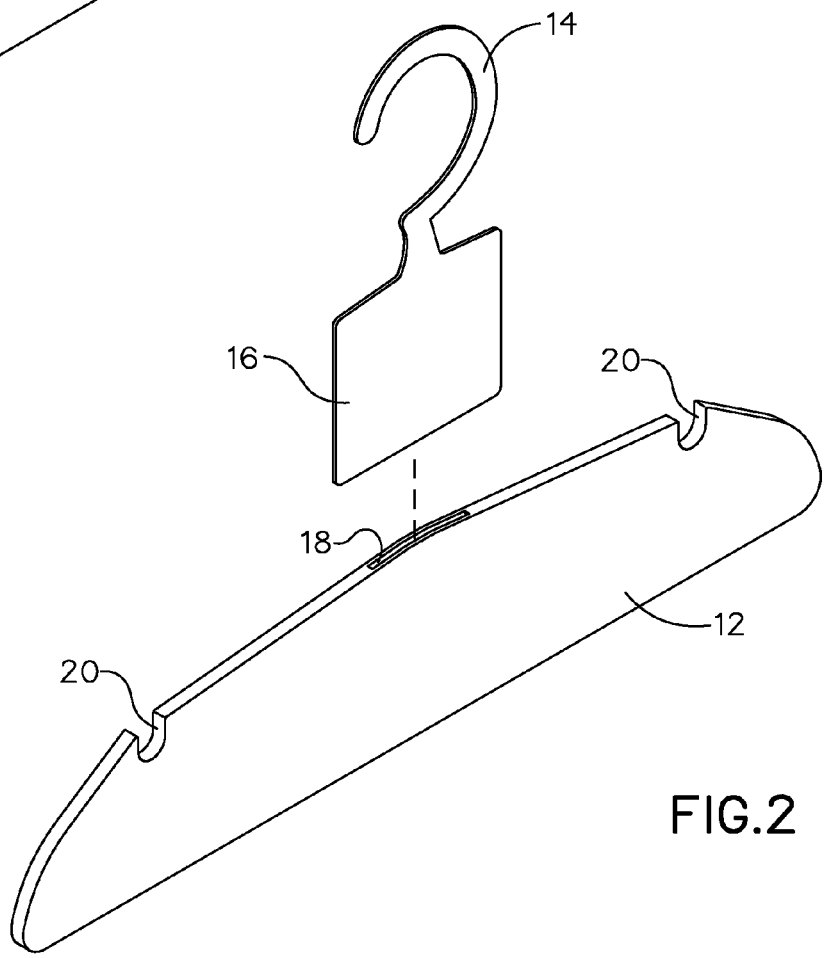
FIG. 2 is an exploded view of one embodiment of the present invention.
Figure 3:
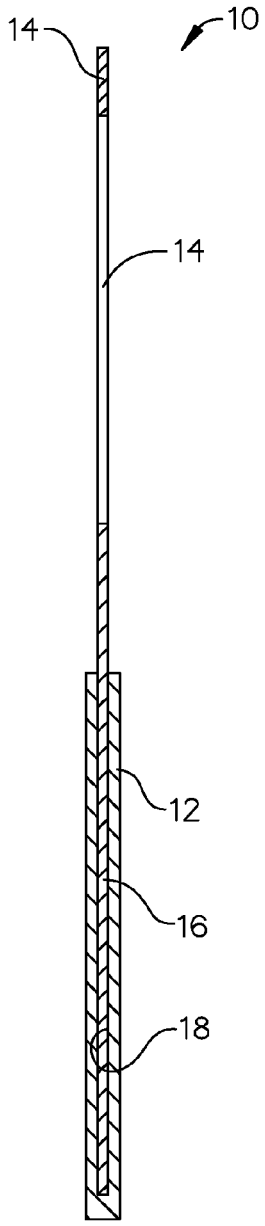
FIG. 3 is a section view of one embodiment of the present invention, taken along line 3-3 in FIG. 1.
Figure 4:
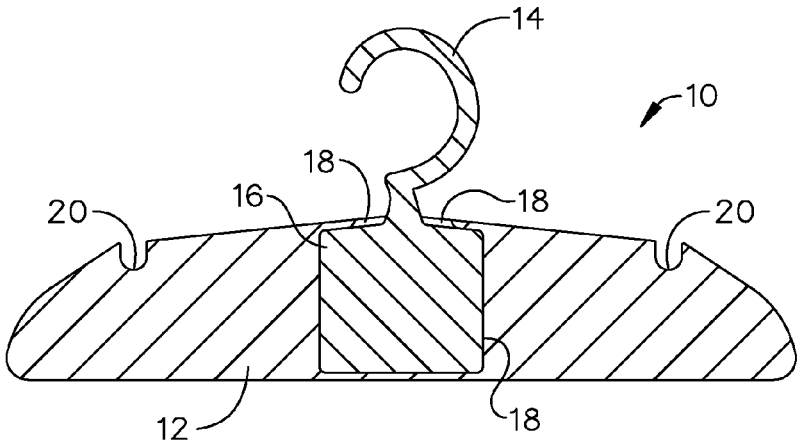
FIG. 4 is a section view of one embodiment of the present invention, taken along line 4-4 in FIG. 1.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used to hang clothes in a closet or on any other rod or hook and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Hanger Body
2. Hook

The various elements of the bendable clothes hanger of the present disclosure may be related in the following exemplary fashion. It is not intended to limit the scope or nature of the relationships between the various elements and the following examples are presented as illustrative examples only.

By way of example, and referring to FIGS. 1-5, some embodiments of the bendable clothes hanger 10 of the present disclosure comprise a silicone hanger body 12 connected to a hook 14, wherein the hook 14 is configured to engage with an item, such as a closet rod, such that the bendable clothes hanger 10 may hang. In some embodiments, the hook 14 has a plate 16 extending from the end of the hook 14 opposite the curved portion, wherein the plate 16 is positioned within the interior of the silicone hanger body 12 and the curved portion of the hook extends out of the interior of the silicone hanger body 12 through a slot 18. In some embodiments, the silicone hanger body 12 may comprise at least two notches 20 in an upper surface thereof, wherein the notches 20 are configured to engage with straps on an article of clothing.

Figure 5:
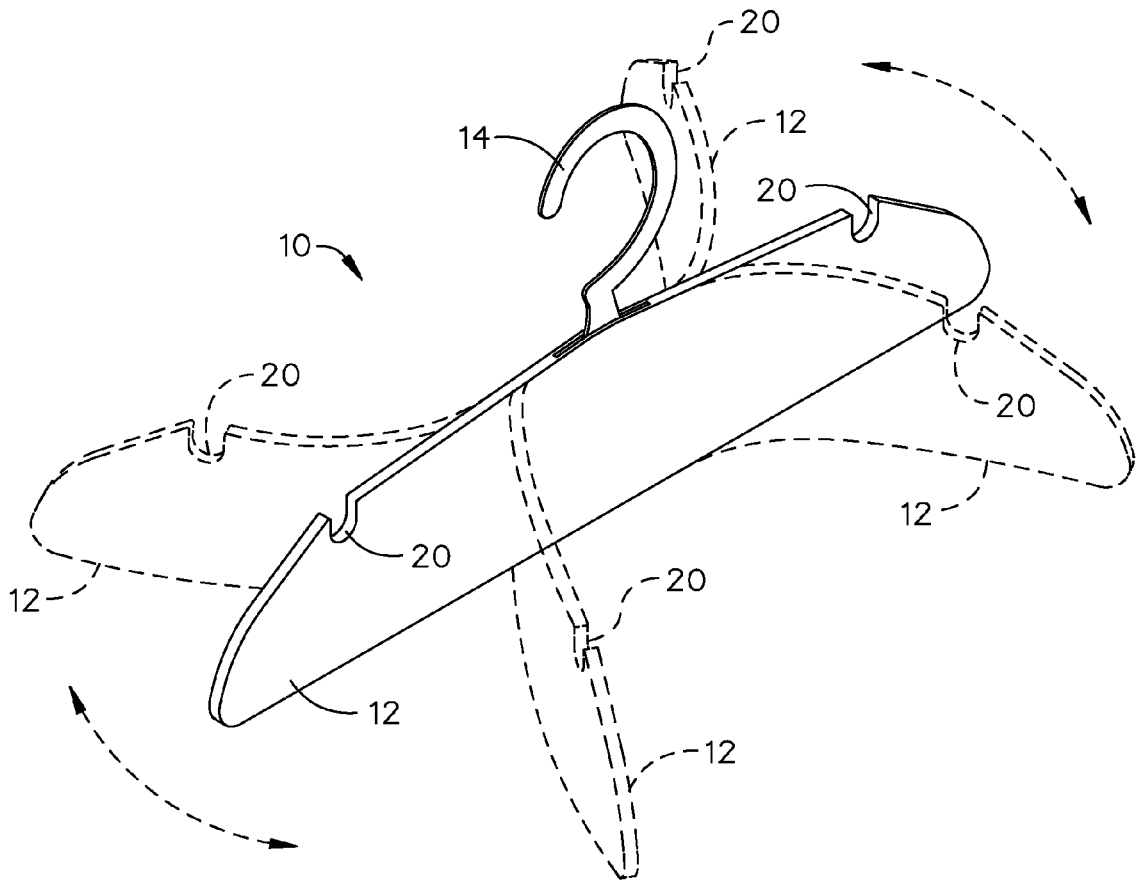
FIG. 5 is a perspective view of one embodiment of the present invention, illustrating the flexing of the hanger body.

As shown in FIGS. 1-5, the hanger body 12 may have a shape substantially similar to the shape of a conventional wire hanger. However, unlike a conventional wire hanger that has an opening in the middle of its "hanger body," the silicone hanger body 12 of the present disclosure is a solid object. In other words, the silicone hanger body 12 of the present disclosure may have no channels, orifices, or holes extending through the silicone hanger body 12. As a result, the hanger 10 of the present disclosure may not become tangled with adjacent hangers. While the silicone hanger body 12 is solid, because it comprises a silicone material, the silicone hanger body 12 is foldable and bendable, as shown in FIG. 5. As a result, the silicone hanger body 12 may be inserted into a garment, such as a shirt, without a user having to stretch the collar of the shirt. Moreover, because the hanger body 12 comprises silicone, the hanger body 12 may also be non-slip, such that an article of clothing may not slide off of the bendable clothes hanger 10 when in use.

The hook 14 may be any shape configured to engage with an item, such as a closet rod, such that the hanger 10 is configured to hang from the item. For example, as shown in FIGS. 1-5, the hook 14 may be curved in a c-type configuration. In some embodiments, rather than the edges of the hook 14 being rounded, the hook 14 may be substantially flat with squared-off edges. When the hook 14 is flat, it may be less likely to tangle with adjacent hooks.

The hanger 10 of the present disclosure may have any necessary or desired size and shape. The edges of the hanger body 12 may be rounded, so as to not damage clothing into which the hanger body 12 is inserted. In a particular embodiment, the length of the bottom surface of the hanger body 12 (or the surface of the hanger body 12 opposite the hook 14) may be about 387.5 mm; the height of the hanger body from the top surface of the hanger body 12 (the surface closest to the hook 14) to the bottom surface of the hanger body 12 may be approximately 80.4 mm; two notches may be positioned on the top surface of the hanger body 12 and may be approximately 263.4 mm apart and 12.5 mm deep; the height of the hook 14 from where the hook 14 meets the top surface of the hanger body 12 to a top most point of the hook 14 may be about 92.3 mm; a distance from the end of the curved edge of the hook 14 to the top surface of the hanger body 12 may be about 60.5 mm; the width of the hook 14 may be about 67.5 mm; and the width of the hanger body 12 may be about 4 mm. Additionally, the plate 16 may have any desired shape and size and, in some embodiments, is substantially rectangular with a width of about 3.5 inches and a height of about 5 inches.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A bendable clothes hanger for hanging clothing, the bendable clothes hanger comprising:

a silicone hanger body; consisting of a silicone panel with an interior space; and a hook attached to the silicone hanger body, wherein:

the hook comprises a curved portion and a plate extending from a bottom portion of the curved portion;

the plate is enveloped within the interior of the silicone hanger body; and the curved portion of the hook extends out of the interior of the silicone hanger body through a slot.

2. The bendable clothes hanger of claim 1, wherein the silicone hanger body comprises a plurality of notches, the notches being configured to engage with straps from an article of clothing.

3. The bendable clothes hanger of claim 1, wherein the hook is substantially flat.

4. A bendable clothes hanger for hanging clothing, the bendable clothes hanger comprising:

a silicone hanger body; and a substantially flat hook attached to the silicone hanger body, the hook comprising a curved portion and a plate extending from a bottom portion of the curved portion, wherein the plate is enveloped within an interior of the silicone hanger body and the curved portion of the hook extends out of the interior of the silicone hanger body through a slot, wherein:

the hook is configured to engage with an object to hang the bendable clothes hanger therefrom; and the silicone hanger body is configured to bend to be placed within an article of clothing.

5. The bendable clothes hanger of claim 4, wherein the silicone hanger body comprises a plurality of notches, the notches being configured to engage with straps from the article of clothing.

6. The bendable clothes hanger of claim 4, wherein a length of a bottom surface of the silicone hanger body is about 387.5 mm long.

7. A bendable clothes hanger for hanging clothing, the bendable clothes hanger comprising:

a silicone hanger body; and a hook attached to the silicone hanger body, the hook comprising a curved portion and a plate extending from a bottom portion of the curved portion, wherein:

the plate is enveloped within an interior of the silicone hanger body; and the curved portion of the hook extends out of the interior of the silicone hanger body through a slot.

8. the bendable clothes hanger of claim 7, wherein the silicone hanger body is a solid object devoid of orifices extending therethrough.

* * * * *